US011358823B2

(12) United States Patent
Tyson et al.

(10) Patent No.: US 11,358,823 B2
(45) Date of Patent: Jun. 14, 2022

(54) ADHESIVE DISPENSER DEVICE

(71) Applicant: Victory Operations, LLC, Monroe, NC (US)

(72) Inventors: Patrick Tyson, Monroe, NC (US); Scott Rendel, Rock Hill, SC (US); David Kittle, Charlotte, NC (US)

(73) Assignee: Victory Operations, LLC, Monroe, NC (US)

( * ) Notice: Subject to any disclaimer, the term of this patent is extended or adjusted under 35 U.S.C. 154(b) by 0 days.

(21) Appl. No.: 17/308,573

(22) Filed: May 5, 2021

(65) Prior Publication Data

US 2021/0347597 A1 Nov. 11, 2021

Related U.S. Application Data

(60) Provisional application No. 63/021,259, filed on May 7, 2020.

(51) Int. Cl.
*B65H 35/00* (2006.01)
*B65H 37/00* (2006.01)

(52) U.S. Cl.
CPC ..... *B65H 35/0026* (2013.01); *B65H 37/007* (2013.01)

(58) Field of Classification Search
CPC ..... B65H 37/007; B65H 35/0026
USPC ..... 156/577
See application file for complete search history.

(56) References Cited

U.S. PATENT DOCUMENTS 5,316,613 A * 5/1994 Samuelson ..... B65H 37/007 156/234
5,507,908 A * 4/1996 Fukushima ..... B65H 37/007 156/234
7,204,287 B2 * 4/2007 Casaldi ..... B65H 37/007 118/257
7,441,580 B2 * 10/2008 Lee ..... B65H 35/0033 156/527
8,528,616 B2 * 9/2013 Lessig ..... B65H 35/0033 156/526
8,579,000 B2 * 11/2013 Yen ..... B65H 37/007 156/577
9,108,457 B2 * 8/2015 Ohashi ..... B65H 37/007
2008/0223511 A1 * 9/2008 Schumacher ..... B65H 37/007 156/230

* cited by examiner

*Primary Examiner* — James D Sells
(74) *Attorney, Agent, or Firm* — Clements Bernard Baratta; Lawrence A. Baratta, Jr.

(57) ABSTRACT

An adhesive dispenser is disclosed. The adhesive dispenser includes a cartridge, a dispensing roll, a plunger assembly, and a handle. The cartridge defines a cavity. The dispensing roll is positioned within the cavity and adapted to dispense an adhesive tape. The plunger assembly is positioned within the cavity and is adapted to move relative to the cartridge. The handle is adapted to receive the cartridge therein and is adapted to move the plunger assembly relative to the cartridge such that the plunger assembly applies a section of the adhesive tape to a surface adjoining a bottom portion of the cartridge.

19 Claims, 11 Drawing Sheets

ADHESIVE DISPENSER DEVICE

CROSS-REFERENCE TO RELATED APPLICATION

The present disclosure claims the benefit of priority of U.S. Provisional Patent Application 63/021,259, filed on May 7, 2020, and entitled "ADHESIVE DISPENSER DEVICE," the contents of which are incorporated in full by reference herein.

FIELD OF THE DISCLOSURE

The present invention relates generally to an adhesive dispenser. More particularly, the present disclosure relates to systems and methods for applying adhesive tape, such as pressure sensitive tape, labels, and stickers, onto a surface.

BACKGROUND OF THE DISCLOSURE

Adhesive tapes are used for many purposes, such as for wrapping gifts, holding items together, construction, repairs, and the like. Obtaining a length of adhesive tape from a roll of the adhesive tape and/or a dispenser of adhesive tape of requires the use of two hands, one to hold the rolls/dispenser and the other to pull the length of adhesive tape and tear the length of adhesive tape from the roll. Thus, it can be difficult to both hold the items together that will be joined by the length of adhesive tape while dispensing the length of adhesive tape. There is a need for an adhesive tape dispenser that can be used to easily dispense adhesive tape with one hand.

The above-described background relating to adhesive tape dispensing is merely intended to provide a contextual overview of some current issues and is not intended to be exhaustive. Other contextual information may become apparent to those of ordinary skill in the art upon review of the following description of exemplary embodiments.

BRIEF SUMMARY OF THE DISCLOSURE

The present disclosure generally provides an adhesive dispenser that is adapted to dispense the section of adhesive tape with only one hand of the user thereof. In some embodiments, a plunger assembly is adapted to separate the section from an adhesive tape being fed through the plunger assembly. In some embodiments, the adhesive dispenser is adapted to gather the waste adhesive tape and respool it for disposal thereof.

In one exemplary embodiment, the present disclosure provides an adhesive dispenser. The adhesive dispenser includes a cartridge, a dispensing roll, a plunger assembly, and a handle. The cartridge defines a cavity. The dispensing roll is positioned within the cavity and adapted to dispense an adhesive tape. The plunger assembly is positioned within the cavity and is adapted to move relative to the cartridge. The handle is adapted to receive the cartridge therein and is adapted to move the plunger assembly relative to the cartridge such that the plunger assembly applies a section of the adhesive tape to a surface adjoining a bottom portion of the cartridge.

In another exemplary embodiment, the present disclosure provides and adhesive dispenser. The adhesive dispenser includes a cartridge, a dispensing roll, a plunger assembly, and a handle. The cartridge defines a cavity and including slots in opposing sides thereof. The dispensing roll is positioned within the cavity and is adapted to dispense an adhesive tape. The plunger assembly is positioned within the cavity and is adapted to move relative to the cartridge. The plunger assembly includes catches. Each of the catches extends through one of the slots. The handle is adapted to receive the cartridge therein. The handle includes notches with the catches received therein whereby the handle moves the plunger assembly relative to the cartridge such that the plunger assembly applies a section of the adhesive tape to a surface adjoining a bottom portion of the cartridge.

In a further exemplary embodiment, the present disclosure provides and adhesive dispenser. The adhesive dispenser includes a cartridge, a dispensing roll, a plunger assembly, a handle, a biasing element, a tape rolling assembly, an arm, and a waste spool assembly. The cartridge defines a cavity. The dispensing roll is positioned within the cavity and adapted to dispense an adhesive tape. The plunger assembly is positioned within the cavity and is adapted to move relative to the cartridge. The handle is adapted to receive the cartridge therein and is adapted to move the plunger assembly relative to the cartridge such that the plunger assembly applies a section of the adhesive tape to a surface adjoining a bottom portion of the cartridge. The biasing element is adapted to bias the plunger assembly away from the bottom portion of the cartridge such that after the section of the adhesive tape is applied to the surface. The biasing element pushes the plunger assembly and the handle away from the bottom portion of the cartridge. The tape rolling assembly is positioned within the cartridge adapted to feed the adhesive tape through the cartridge. The tape rolling assembly includes a roller adapted to only rotate in a feed direction of the adhesive tape. The arm is connected to the plunger assembly. The arm is adapted to rotate the tape rolling assembly to cause the roller to feed the adhesive tape through the cartridge. The waste spool assembly is positioned within the cartridge downstream of the tape rolling assembly. The waste spool assembly is adapted to be rotated by the roller and is adapted to spool waste adhesive tape that has the section removed therefrom. The waste spool assembly includes a ratcheting arrangement such that a waste spool of the waste spool assembly rotates less than the roller such that an amount of waste adhesive tape fed by the roller matches the amount of waste adhesive tape spooled by the waste spool.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

The present invention may be understood more readily by reference to the following detailed description of the invention taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In various embodiments, the present disclosure relates to systems and methods for dispensing sections of adhesive tape. In particular, the present disclosure discloses an adhesive dispenser that is adapted to dispense the section of adhesive tape with only one hand of the user thereof. In some embodiments, a plunger assembly is adapted to separate the section from an adhesive tape being fed through the plunger assembly. In some embodiments, the adhesive dispenser is adapted to gather the waste adhesive tape and respool it for disposal thereof. This respooling simplifies the use of the adhesive dispenser while making the individual use thereof cleaner and without the need to dispose of the waste thereafter.

Figure 1:
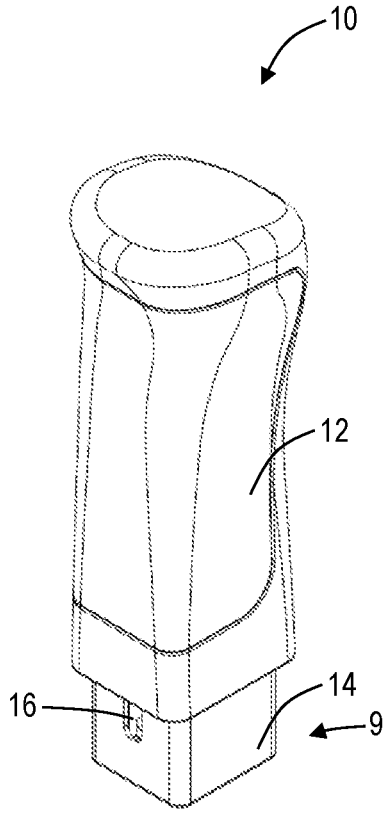
FIG. 1 is a perspective view of an illustrative embodiment of the adhesive dispenser of the present disclosure.
Figure 2:
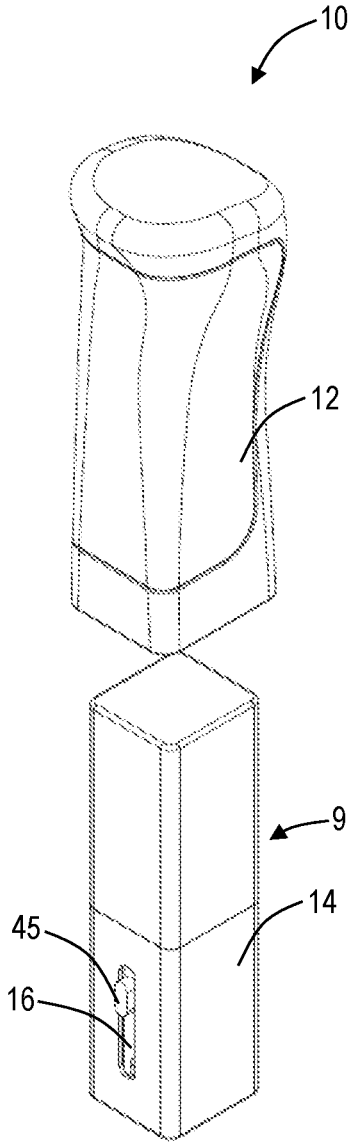
FIG. 2 is a perspective view of the illustrative embodiment of the adhesive dispenser of FIG. 1 highlighting the handle and the cartridge assembly thereof.
Figure 3:
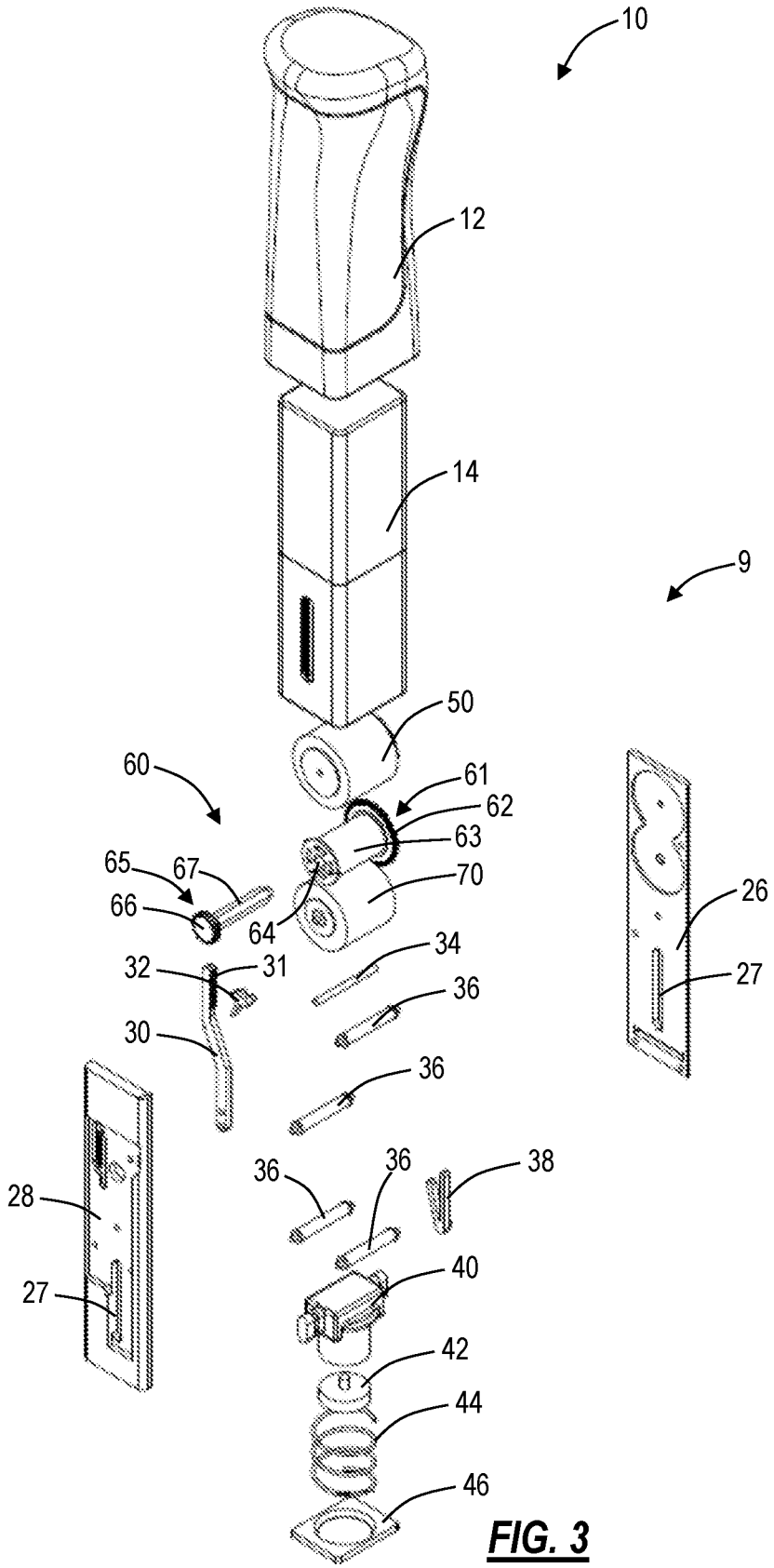
FIG. 3 is an exploded perspective view of the illustrative embodiment of the adhesive dispenser of FIG. 1.
Figure 4:
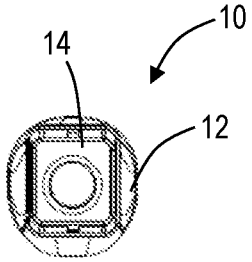
FIG. 4 is a bottom perspective view of the illustrative embodiment of the adhesive dispenser of FIG. 1.
Figure 5:
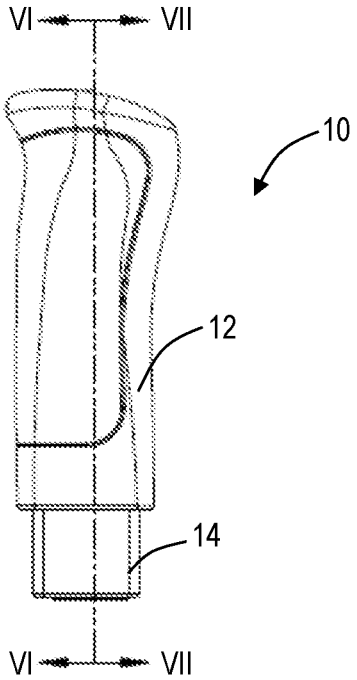
FIG. 5 is a side perspective view of the illustrative embodiment of the adhesive dispenser of FIG. 1.
Figure 6:
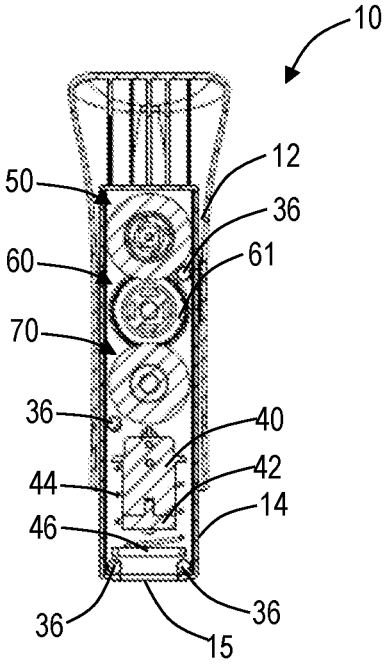
FIG. 6 is a cross-sectional view taken along the line VI-VI of the illustrative embodiment of the adhesive dispenser of FIG. 1.
Figure 7:
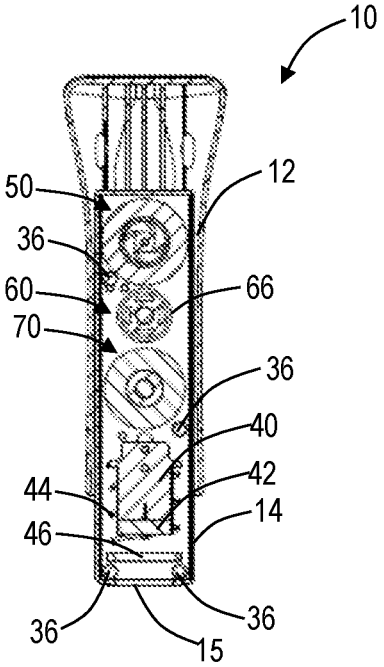
FIG. 7 is a cross-sectional view taken along the line VII-VII of the illustrative embodiment of the adhesive dispenser of FIG. 1.

FIG. 1 is a perspective view of an illustrative embodiment of the adhesive dispenser 10 of the present disclosure. FIG. 2 is a perspective view of the illustrative embodiment of the adhesive dispenser 10 of FIG. 1 highlighting the handle 12 and the cartridge assembly 9 thereof. FIG. 3 is an exploded perspective view of the illustrative embodiment of the adhesive dispenser 10 of FIG. 1. FIG. 4 is a bottom perspective view of the illustrative embodiment of the adhesive dispenser 10 of FIG. 1. FIG. 5 is a side perspective view of the illustrative embodiment of the adhesive dispenser 10 of FIG. 1. FIG. 6 is a cross-sectional view taken along the line VI-VI of the illustrative embodiment of the adhesive dispenser 10 of FIG. 1. FIG. 7 is a cross-sectional view taken along the line VII-VII of the illustrative embodiment of the adhesive dispenser 10 of FIG. 1. Referring now specifically to FIGS. 1-7, in embodiments, the adhesive dispenser 10 includes a handle 12 and a cartridge assembly 9 received within the handle 12, such as in a telescoping relationship.

Figure 8:
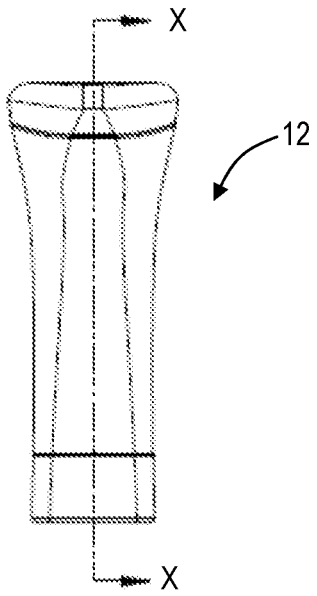
FIG. 8 is a back perspective view of an illustrative embodiment of the handle for the adhesive dispenser of FIG. 1.
Figure 9:
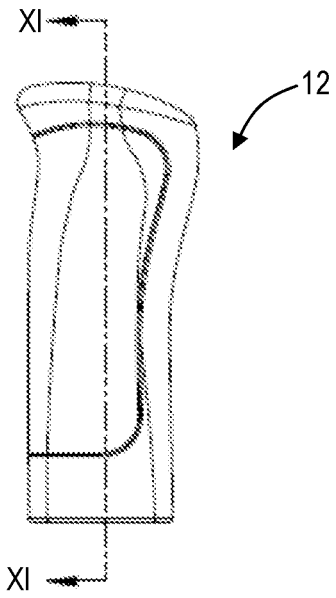
FIG. 9 is a side perspective view of the illustrative embodiment of the handle of FIG. 8.
Figure 10:
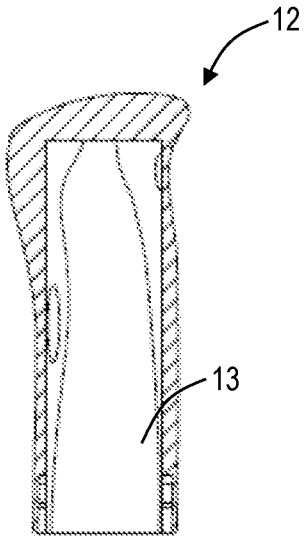
FIG. 10 is a cross-sectional view of the illustrative embodiment of the handle of FIG. 8 taken along the line X-X of FIG. 8.
Figure 11:
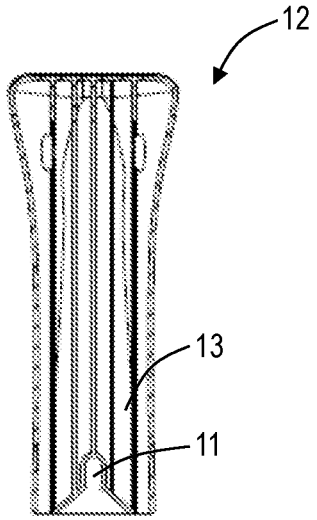
FIG. 11 is a cross-sectional view of the illustrative embodiment of the handle of FIG. 8 taken along the line XI-XI of FIG. 9.

FIG. 8 is a back perspective view of an illustrative embodiment of the handle 12 for the adhesive dispenser 10 of FIG. 1. FIG. 9 is a side perspective view of the illustrative embodiment of the handle 12 of FIG. 8. FIG. 10 is a cross-sectional view of the illustrative embodiment of the handle 12 of FIG. 8 taken along the line X-X of FIG. 8. FIG. 11 is a cross-sectional view of the illustrative embodiment of the handle 12 of FIG. 8 taken along the line XI-XI of FIG. 9. Referring now specifically to FIGS. 8-11, the handle 12 has an internal cavity 13 for receiving the cartridge 14, therein. In embodiments, the handle 12 has an outer surface and an inner surface. The cavity 13 of the handle 12 is bounded by the inner surface. The handle 12 has a grip portion that is ergonomically designed to be held by one hand of a user. In some embodiments, the handle 12 is composed of plastic and the ergonomic portion that is centrally located within the handle 12 is also composed of plastic. However, in other embodiments, other materials are used for the handle 12. In embodiments, the handle 12 includes a top portion, a bottom portion, and four side portions. In the embodiment illustrated, the ergonomic portion of the handle 12 is on three of the four side portions. The bottom portion of the handle 12 includes an opening for providing entry into the cavity 13 of the handle 12.

As can be seen in FIG. 11, in embodiments, the sides of the handle 12 include a notch 11. In the embodiment illustrated, the notch 11 is positioned within an interior of the handle 12. The notch 11 is adapted to receive catches 45 of a plunger 40 (FIGS. 24-27) of the cartridge 14.

Referring to FIG. 3, in embodiments, the cartridge assembly 9 includes a cartridge 14, a first side frame 26, a second side frame 28, a dispensing spool assembly 70, a plunger assembly 40, an applicator 42, a waste spool assembly 50, a tape rolling assembly 60, tape guide rollers 36, a pin 34, an actuating spring 44, a retaining plate 46, and a leaf spring 38. The cartridge assembly 9 is adapted to, upon actuation thereof, feed adhesive tape therethrough and punch a section of the adhesive tape and apply the section to a surface adjoining thereto utilizing the plunger assembly 40. In embodiments, the adhesive tape is pressure sensitive tape, labels, or stickers.

Figure 12:
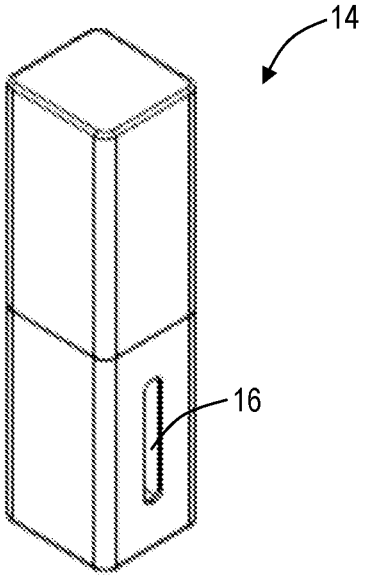
FIG. 12 is a perspective view of an illustrative embodiment of the cartridge for the adhesive dispenser of FIG. 1.
Figure 13:
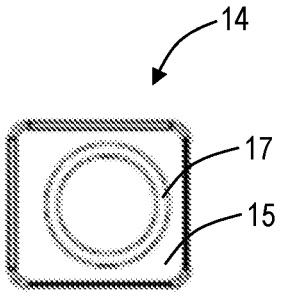
FIG. 13 is a bottom perspective view of the illustrative embodiment of the cartridge of FIG. 12.
Figure 14:
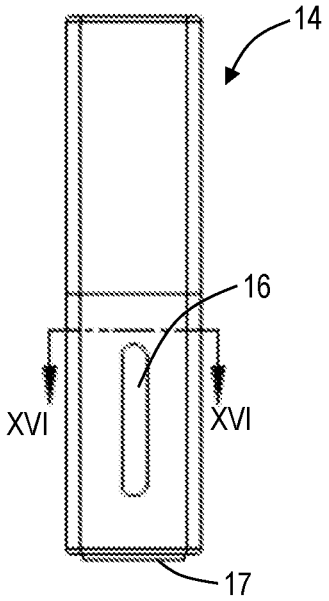
FIG. 14 is a side perspective view of the illustrative embodiment of the cartridge of FIG. 12.
Figure 15:
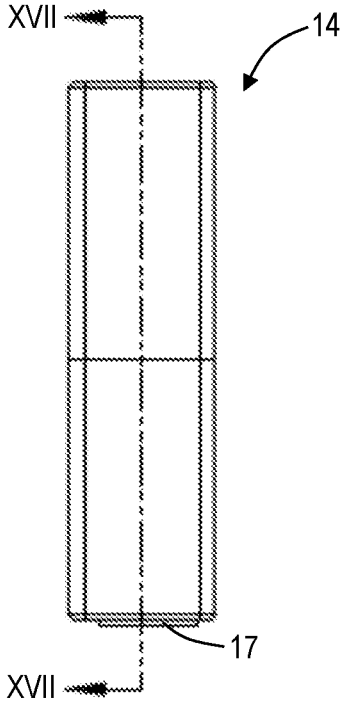
FIG. 15 is a front perspective view of the illustrative embodiment of the cartridge of FIG. 12.
Figure 16:
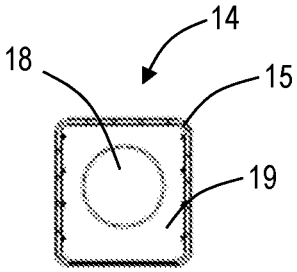
FIG. 16 is a cross-sectional view of the illustrative embodiment of the cartridge of FIG. 12 taken along the line XVI-XVI of FIG. 14.
Figure 17:
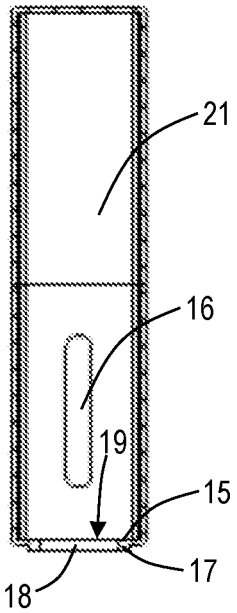
FIG. 17 is a cross-sectional view of the illustrative embodiment of the cartridge of FIG. 12 taken along the line XVI-XVI of FIG. 15.

FIG. 12 is a perspective view of an illustrative embodiment of the cartridge 14 for the adhesive dispenser 10 of FIG. 1. FIG. 13 is a bottom perspective view of the illustrative embodiment of the cartridge 14 of FIG. 12. FIG. 14 is a side perspective view of the illustrative embodiment of the cartridge 14 of FIG. 12. FIG. 15 is a front perspective view of the illustrative embodiment of the cartridge 14 of FIG. 12. FIG. 16 is a cross-sectional view of the illustrative embodiment of the cartridge 14 of FIG. 12 taken along the line XVI-XVI of FIG. 14. FIG. 17 is a cross-sectional view of the illustrative embodiment of the cartridge 14 of FIG. 12 taken along the line XVI-XVI of FIG. 15. Referring now specifically to FIGS. 12-17, in embodiments, the cartridge 14 has a top portion, a bottom portion 15, and four side portions. In embodiments, the width of the cartridge 14 is slightly less than the width of the cavity of the handle 12, allowing the cartridge 14 to be received within the cavity of the handle 12. In embodiments, the cartridge 14 includes a pair of opposed slots 16 located side portions of the cartridge 14. In the embodiment illustrated, the slots 16 are positioned in close proximity to the bottom portion 15 of the cartridge 14. The slots 16 extend from the exterior surface to the interior surface of the cartridge 14 and extend in a vertical direction between the top portion and the bottom portion 15.

As can be seen in FIGS. 16 and 17, in embodiments, the bottom portion 15 includes an opening 18 for dispensing a section of adhesive tape therethrough, an internal surface 19 surrounding the opening 18, and a protrusion 17, also surrounding the opening and extending downward, away from the top portion. In embodiments, the internal surface 19 comprises at least one of a material and a texture that limits the adhesion of the adhesive tape thereto. In some embodiments, the bottom portion 15 comprises the material, and in other embodiments, the internal surface 19 is coated with such a material. In embodiments, the protrusion 17 is adapted to contact the surface(s) to which the section of adhesive tape for applying the section thereto.

As can be seen in FIG. 17, the cartridge 14 has an internal cavity 21 bounded by the interior surface of the cartridge 14 and, as will be discussed in greater detail below, is adapted to contain the various components for dispensing sections of adhesive tape. In embodiments, the cartridge 14 has a generally square or rectangular cross section.

Referring again to FIG. 3, in embodiments, the first side frame 26 and the second side frame 28 are disposed within the internal cavity of the cartridge 14, such as on the interior surface of the side portions containing the opposed slots 16. The exterior side of the first side frame 26 and the second side frame 28 are generally flat or smooth. As shown in FIG. 3, each of the first side frame 26 and the second side frame 28 contains a slot 27 extending from the exterior side to the interior side of the first side frame 26 and second side frame 28, respectively. Each slot 27 aligns with a corresponding slot 16 on the adjacent side portion of the cartridge 14 and has a length corresponding to a length of the slot 16. In the embodiment illustrated, each slot 27 is disposed near the bottom portion of the first side frame 26.

In the embodiment illustrated in FIG. 3, the first side frame 26 and the second side frame 28 include indentions adapted to receive ends of the various components held therebetween, and in particular, geared ends of the components, such as the geared ends of the waste spool assembly 50 and the tape rolling assembly 60. In embodiments, the indentations are in the shape of cylindrical indentations. In the embodiment illustrated, the first side frame 26 includes two overlapping cylindrical indentations that are adapted to receive geared ends of the waste spool assembly 50 and the tape rolling assembly 60.

Figure 18:
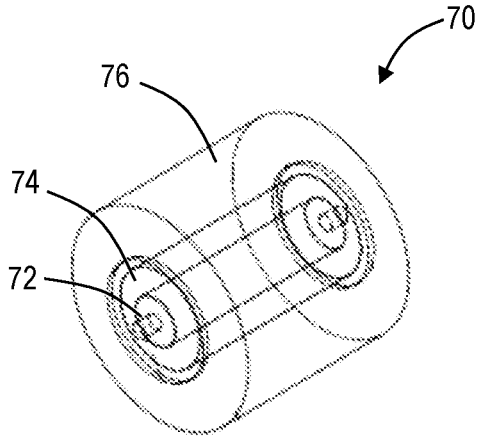
FIG. 18 is a perspective view of an illustrative embodiment of the dispensing spool assembly for the adhesive dispenser of FIG. 1.
Figure 19:
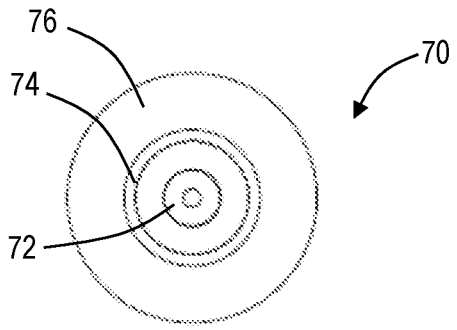
FIG. 19 is a side perspective view of the illustrative embodiment of the dispensing spool assembly of FIG. 18.
Figure 20:
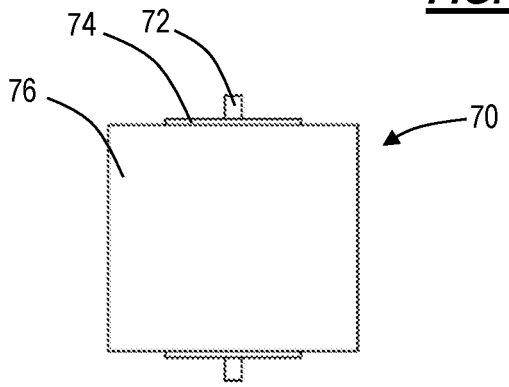
FIG. 20 is a front perspective view of the illustrative embodiment of the dispensing spool assembly of FIG. 18.
Figure 21:
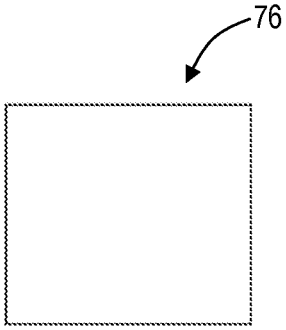
FIG. 21 is a front perspective view of an illustrative embodiment of the dispensing roll of the dispensing spool assembly of FIG. 18.
Figure 22:
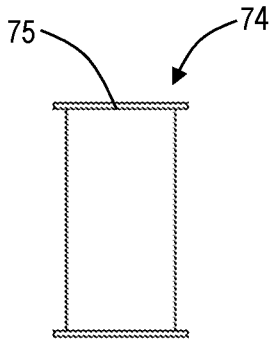
FIG. 22 is a front perspective view of an illustrative embodiment of the dispensing spool of the dispensing spool assembly of FIG. 18.
Figure 23:
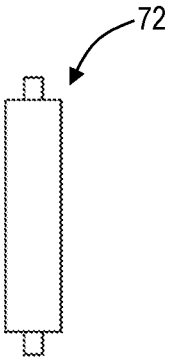
FIG. 23 is a front perspective view of an illustrative embodiment of the axle of the dispensing spool assembly of FIG. 18.

FIG. 18 is a perspective view of an illustrative embodiment of the dispensing spool assembly 70 for the adhesive dispenser of FIG. 1. FIG. 19 is a side perspective view of the illustrative embodiment of the dispensing spool assembly 70 of FIG. 18. FIG. 20 is a front perspective view of the illustrative embodiment of the dispensing spool assembly 70 of FIG. 18. FIG. 21 is a front perspective view of an illustrative embodiment of the dispensing roll 76 of the dispensing spool assembly 70 of FIG. 18. FIG. 22 is a front perspective view of an illustrative embodiment of the dispensing spool 74 of the dispensing spool assembly 70 of FIG. 18. FIG. 23 is a front perspective view of an illustrative embodiment of the axle 72 of the dispensing spool assembly 70 of FIG. 18. Referring to FIGS. 18-23, the dispensing spool assembly 70 is disposed between the first side frame 26 and the second side frame 28. In the embodiment illustrated, the dispensing spool assembly 70 is positioned between the plunger assembly 40 and the tape rolling assembly 60. In the embodiment illustrated, dispensing spool assembly 70 includes a dispensing spool 74, a dispensing roll 76 of adhesive tape that is wound around a dispensing spool 74, and an axle 72. In embodiments, the ends of the axle 72 are received within and rotationally engaged with corresponding indentations holes in the interior side of the first side frame 26 and the interior side of the second side frame 28. The dispensing spool assembly 70 is adapted to provide the adhesive tape that will be fed through the cartridge assembly 9, which adhesive tape will have sections punched therefrom, as will be described in greater detail below, and applied to a surface adjoining the bottom portion 17 of the cartridge 14.

Various sizes and types of adhesives tapes can be used within the adhesive dispenser 10. In embodiments, multiple, separate, dispensing spools 74 are provided, which are adapted for the size of the adhesive tape and for the type of adhesive tape, such as pressure sensitive tape, stickers, labels, and the like. For example, a distance between the sides 75 of the dispensing spool 74 can be changed depending on a size of the adhesive tape to be dispensed by the adhesive dispenser 10.

Figure 24:
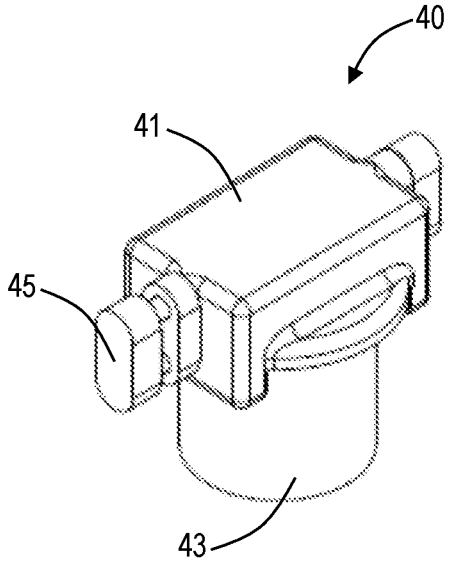
FIG. 24 is a perspective view of an illustrative embodiment of the plunger assembly for the adhesive dispenser of FIG. 1.
Figure 25:
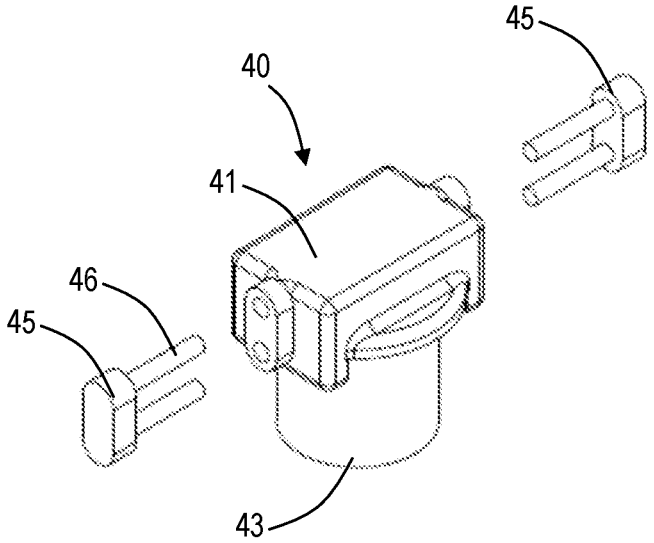
FIG. 25 is an exploded perspective view of an illustrative embodiment of the plunger assembly of FIG. 24.
Figure 26:
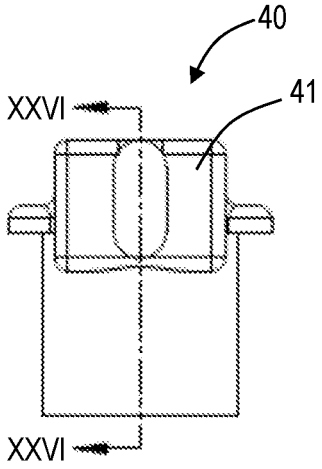
FIG. 26 is a side perspective view of an illustrative embodiment of the plunger assembly of FIG. 24.
Figure 27:
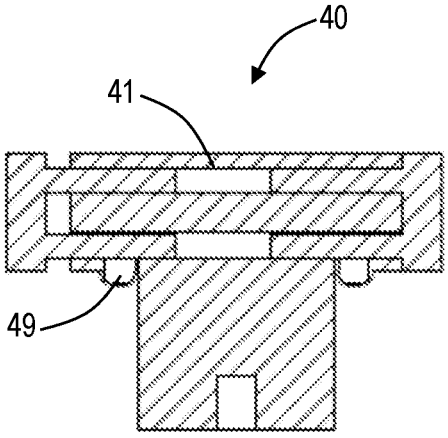
FIG. 27 is a cross-sectional view of the illustrative embodiment of the plunger assembly of FIG. 24 taken along the line XXVI-XXVI of FIG. 26.

FIG. 24 is a perspective view of an illustrative embodiment of the plunger assembly 40 for the adhesive dispenser 10 of FIG. 1. FIG. 25 is an exploded perspective view of an illustrative embodiment of the plunger assembly 40 of FIG. 24. FIG. 26 is a side perspective view of an illustrative embodiment of the plunger assembly 40 of FIG. 24. FIG. 27 is a cross-sectional view of the illustrative embodiment of the plunger assembly 40 of FIG. 24 taken along the line XXVI-XXVI of FIG. 26. Referring to FIGS. 24-27, in embodiments, the plunger assembly 40 includes a top portion 41 and a bottom portion 43. In the embodiment illustrated, the top portion 41 generally includes rectangular shape and includes two outwardly extending catches 45. In the embodiment illustrated, the catches 45 are separate pieces joinable to the top portion 41. In other embodiments, the catches 45 are formed with the top portion 41 as a unitary structure. In embodiments, the catches 45 include members extending therefrom that are adapted to engage with holes formed within the top portion 41. The members and the holes are adapted to secure the catches to the top portion 41. In the embodiment illustrated, the members and the holes are generally cylindrical in shape.

In embodiments, the bottom portion 43 includes a cylindrical shape and extends downwardly from the top portion 41. However, other shapes are also contemplated. In embodiments, the general shape of the bottom portion 43 corresponds to the desired shape of the section of adhesive tape being applied to a surface. In the embodiment illustrated (refer to FIGS. 3, 6, and 7), the bottom portion 43 is adapted to engage an applicator 42. In other embodiments, the applicator 42 is unitarily formed with the bottom portion 43.

Referring to FIG. 2, each of the catches 45 is adapted to extend through a corresponding slot 16 in a side portion of the cartridge 14 as well as the corresponding slots 27 of the first and second side frames 26, 28. In the embodiment illustrated, the catches 45 each extend beyond an outer surface of the corresponding side portion of the cartridge 14 and is adapted to engage a corresponding notch 11 of the handle 12. With the engagement between the notches 11 and the catches 45, the plunger assembly 40 is actuated by movement of the handle 12 relative to the cartridge 14, which moves the plunger assembly 40 relative to the cartridge 14 such that the applicator 42 is pressed into the opening 18 to separate the section of the adhesive tape and apply the section to the adjoining surface. In embodiments, the separation of the section is facilitated by the adhesive tape being pressed against the bottom portion 15 of cartridge 15, where the adhesive tape temporarily sticks thereto and facilitates the removal of the section from the remaining portion of the adhesive tape.

Again, various sizes and types of adhesives tapes can be used within the adhesive dispenser 10. In embodiments, multiple, separate applicators 42 are provided, which are adapted for the size of the adhesive tape to be dispensed by the adhesive dispenser 10.

Referring to FIGS. 3, 6, and 7, in embodiments, the plunger assembly 40 engages a leaf spring 38, which is adapted to stabilize the plunger assembly 40. In embodiments, the applicator 42 is selectively secured to the bottom portion 43. In the embodiment illustrated, the top side of the applicator 42 includes a post that is received within the bottom portion 43 for mating thereto. In embodiments, the biasing element 44, such as a helical spring, is adapted to bias the plunger assembly 40 away from the bottom portion 15 of the cartridge 14. In the embodiment illustrated, the biasing element 44 surrounds the applicator 42 and the bottom portion 43 of the plunger assembly 40. In embodiments, the biasing element 44 extends between and engages the retaining plate 46 and the top portion 41 of the plunger 40. As can be seen in FIG. 27, in embodiments, the top portion 41 includes a slot 49 adapted to receive an end of the biasing element 44. Upon actuation of the plunger assembly 40 by movement of the handle 12 towards the bottom portion 15 of the cartridge 14, the biasing element 44 is compressed, and upon release of the force pressing the handle 12 towards the bottom portion 15, the biasing element 44 pushes the plunger assembly 40 away from the bottom portion 15 back to a static position, such as against the leaf spring 38.

As can be seen in FIGS. 6 and 7, the tape guide rollers 36 are positioned to guide the adhesive tape between components of the cartridge assembly 9. In embodiments, a tape guide roller 36 is positioned below and offset, adjacent to a side of the cartridge 14, to guide the adhesive tape away from the dispensing pool assembly 70. Two more tape guide rollers 36 are positioned adjacent to and offset from the bottom portion 15 of the cartridge 14 to guide the adhesive tape across the bottom portion 15. One of the two tape guide rollers is vertically aligned with the other tape guide roller 36 adjacent to the side of the cartridge 14 to guide the adhesive tape past the plunger assembly 40 and biasing element 44 to ensure that the adhesive tape does not contact those elements. Another tape guide roller 36 is positioned adjacent to the opposing side of the cartridge 14 and is adapted to guide the waste adhesive tape up the opposing side of the cartridge for collection thereof, which collection will be described in further detail below. In embodiments, the tape guide rollers 36 are positioned and adapted to contact a back of the adhesive tape so as to not contact the adhesive thereof.

The tape rolling assembly 60 is adapted to feed the adhesive tape through the cartridge assembly 9. In some embodiments, the tape rolling assembly 60 includes a ratcheting arrangement adapted to only allow rotation of the roller 61 in one direction, and in particular, a feed direction of the adhesive tape, while preventing rotation opposite the feed direction. As can be seen in FIGS. 3, 6, and 7, in embodiments, the tape rolling assembly 60 includes a roller 61, a roller axle 65, an arm 30, and a brake 32.

The roller 61 includes a cylindrical body and a roller gear 62. The cylindrical body 63 is adapted to contact the adhesive tape and assist in the feeding of the adhesive tape through the cartridge assembly 9. In embodiments, the cylindrical body 63 is adapted to contact the adhesive side of the adhesive tape and includes at least one of a material and a texture that limits the adhesion of the adhesive tape thereto. In some embodiments, the cylindrical body 63 comprises the material, and in other embodiments, an outer surface thereof is coated with such a material. In embodiments, the cylindrical body 63 includes a bore 64 with one or more ratcheting features therein. The roller gear 62 is adapted to transfer rotation of the roller 61 to the waste spool assembly 50. In embodiments, the roller gear 62 includes gear teeth disposed along its outer edge and the brake 32 is adapted to engage the gear teeth of the roller gear 62, allowing rotation of the roller 61 in the feed direction, while preventing rotation of the roller 61 in the opposite direction.

The roller axle 65 includes a roller axle body 67 and a roller axle gear 66. The roller axle body 67 is adapted to be received in the bore 64 and also includes ratcheting features therein. The ratcheting features are adapted to engage, such that rotation of the roller axle 65 in the feed direction causes rotation of roller 61 in the feed direction, while rotation of the roller axle 65 in the opposite direction does not cause any rotation of the roller 61. In particular, the ratcheting features are adapted to slip relative to one another while the roller axle 65 rotates in the direction opposite the feed direction. In the embodiment illustrated, the axle gear 66 is positioned on a side of the cartridge 14 opposite the roller gear 62.

The arm 30 includes teeth 31 adapted to mesh with the teeth of the axle gear 66. The arm 30 is adapted to translate relative to the axle gear 66 so as to rotate the axle gear 66. In embodiments, the arm 30 is adapted to move with the plunger assembly 40. In the embodiment illustrated, the arm 30 includes holes that receive the members that secure one of the catches 45 to the top portion 41 of the plunger assembly 40, and the arm 30 is secured to the plunger assembly 40 between the catch 45 and the top portion 41. In embodiments, as the plunger assembly 40 is actuated relative to the cartridge 14, the arm 30 moves relative to the axle gear 66, such that the teeth 31 thereof cause rotation of the axle gear 66 in the feed direction while the arm 30 moves in a first direction and the direction opposite the feed direction while the arm 30 moves in a second direction. In some embodiments, the arm 30 causes the axle gear 66 to rotate in the feed direction on the downstroke of the plunger assembly 40 and in the opposite direction on the upstroke, and in other embodiments, the arm 30 causes the axle gear 66 to rotate in the opposite direction on the downstroke and in the feed direction on the upstroke. Again, while the arm 30 causes the axle gear 66 to rotate in the direction opposite the feed direction, the ratcheting arrangement of the tape rolling assembly 60 prevents the roller 61 from rotating therewith.

Figure 28:
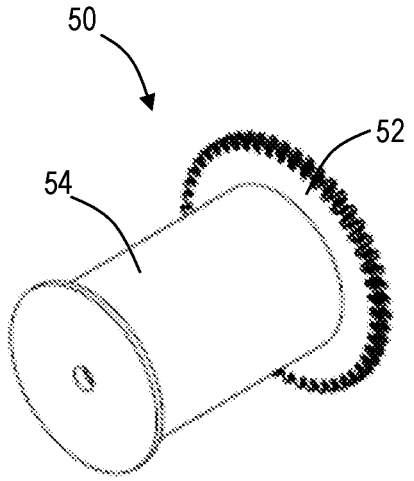
FIG. 28 is a perspective view of an illustrative embodiment of a waste spool assembly for the adhesive dispenser of FIG. 1.
Figure 29:
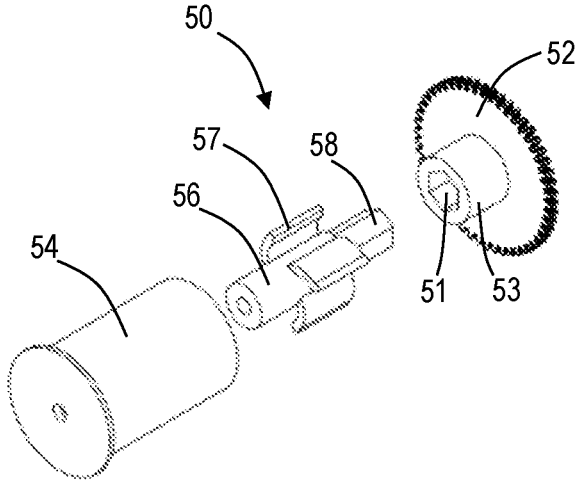
FIG. 29 is an exploded perspective view of an illustrative embodiment of the waste spool assembly of FIG. 28.
Figure 30:
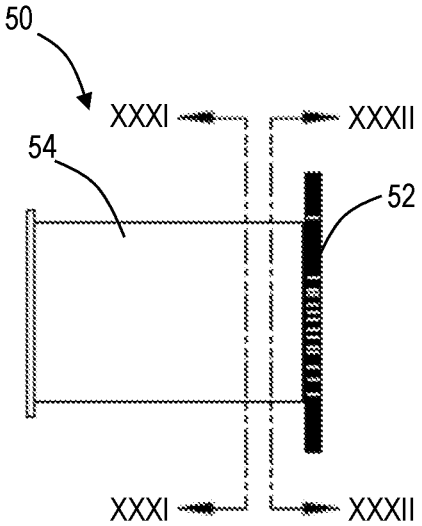
FIG. 30 is a side perspective view of an illustrative embodiment of the waste spool assembly of FIG. 28.
Figure 31:
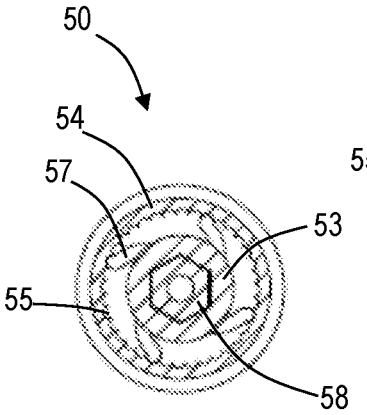
FIG. 31 is a cross-sectional view of the illustrative embodiment of the waste spool assembly of FIG. 28 taken along the line XXVI-XXVI of FIG. 30.
Figure 32:
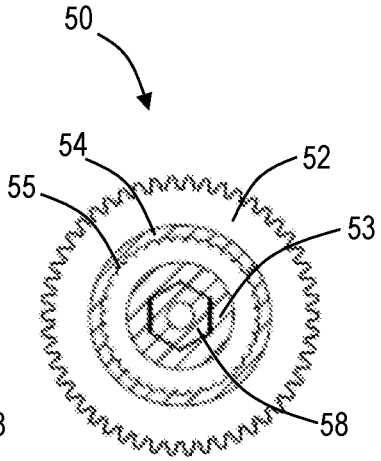
FIG. 32 is a cross-sectional view of the illustrative embodiment of the waste spool assembly of FIG. 28 taken along the line XXVII-XXVII of FIG. 30.

FIG. 28 is a perspective view of an illustrative embodiment of a waste spool assembly 50 for the adhesive dispenser 10 of FIG. 1. FIG. 29 is an exploded perspective view of an illustrative embodiment of the waste spool assembly 50 of FIG. 28. FIG. 30 is a side perspective view of an illustrative embodiment of the waste spool assembly 50 of FIG. 28. FIG. 31 is a cross-sectional view of the illustrative embodiment of the waste spool assembly 50 of FIG. 28 taken along the line XXVI-XXVI of FIG. 30. FIG. 32 is a cross-sectional view of the illustrative embodiment of the waste spool assembly 50 of FIG. 28 taken along the line XXVII-XXVII of FIG. 30. Referring to FIGS. 28-32, in embodiments, the waste spool assembly 50 is adapted to respool the adhesive tape after sections of the adhesive tape has been removed. In the embodiment illustrated, the roller 61 is adapted to cause the waste spool assembly 50 to rotate and respool the adhesive tape.

In embodiments, the waste spool assembly 50 includes a waste spool 54, a waste spool gear 52, and a waste spool ratchet 56. The waste spool 54 is adapted to receive the waste adhesive tape and respool it thereon. In embodiments, the waste spool 54 is at least partially hollow and includes a ratcheting feature 55 therein. In the embodiment illustrated, the ratcheting feature 55 includes grooves in an annular arrangement.

Again, various sizes and types of adhesives tapes can be used within the adhesive dispenser 10. In embodiments, multiple, separate waste spools 54 are provided, which are adapted for the size of the adhesive tape and for the type of adhesive tape.

The waste spool gear 52 includes teeth that are adapted to mesh with the teeth of the roller gear 62, which transfers the rotation of the roller 61 to the waste spool gear 52. The waste spool gear also includes a body 53 forming a screw drive 51. In embodiments, the screw drive 51 is one of a slotted drive, a cruciform drive, a square drive, an internal hex drive, and the like.

The waste spool ratchet 56 includes a screw drive 58 adapted to mate with the screw drive 51 of the waste spool gear 52, where one of the screw drives 51 and 58 is a male screw drive and the other is a female screw drive. In embodiments, the waste spool ratchet 56 also includes ratchet arms 57. In the embodiment illustrated, the ratchet arms 57 extend outward and curve in the circumferential direction. The ratchet arms 57 are adapted to transfer rotation from the waste spool gear 52 to the waste spool 54 until a predetermined force is reached, at which point, the ratchet arms 57 slip relative to the waste spool 54, and in particular, the ratcheting feature 55. As such, in embodiments, as the amount of waste adhesive tape is spooled, a radius for the spooling increases, which causes the amount of adhesive tape spooled by each rotation of the waste spool 54 to increases. As a result, there is a differential between the amount of waste adhesive tape fed by the roller 61 and the waste spool 54. By allowing the waste spool 54 to slip relative to rotation of the roller 61, the amount of waste adhesive tape taken up by the waste spool 54 can match the amount of waste spool being fed by the roller 61. In embodiments, the predetermined force that allows the slip between the ratchet arms 57 slip and the waste spool 54 is less than the minimum force required to tear the waste adhesive tape being spooled.

In embodiments, with each application of a section of the adhesive tape, the roller 61 is rotated to control the amount of the adhesive tape that is pulled through the cartridge assembly 9 such that a next section of adhesive tape is positioned below the applicator 42 and over the opening 18.

Figure 33:
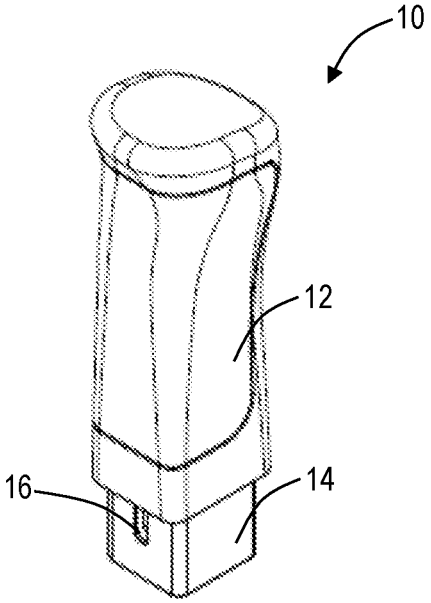
FIG. 33 is a perspective view of another illustrative embodiment of the adhesive dispenser of the present disclosure.
Figure 34:
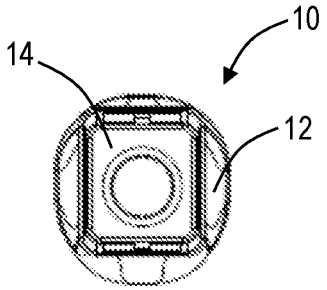
FIG. 34 is a bottom perspective view of the illustrative embodiment of the adhesive dispenser of FIG. 33.
Figure 35:
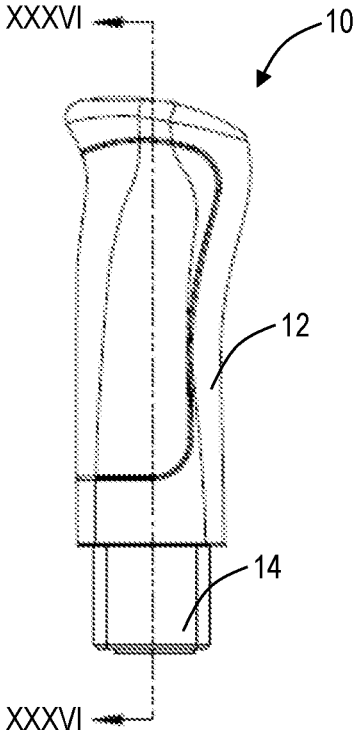
FIG. 35 is a side perspective view of the illustrative embodiment of the adhesive dispenser of FIG. 33.
Figure 36:
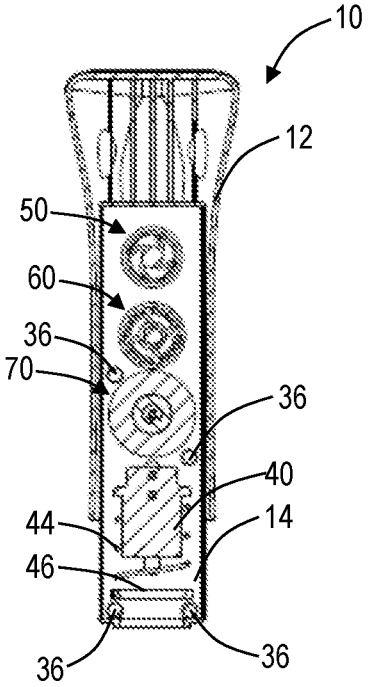
FIG. 36 is a cross-sectional view taken along the line XXXVI-XXXVI of the illustrative embodiment of the adhesive dispenser of FIG. 33.
Figure 37:
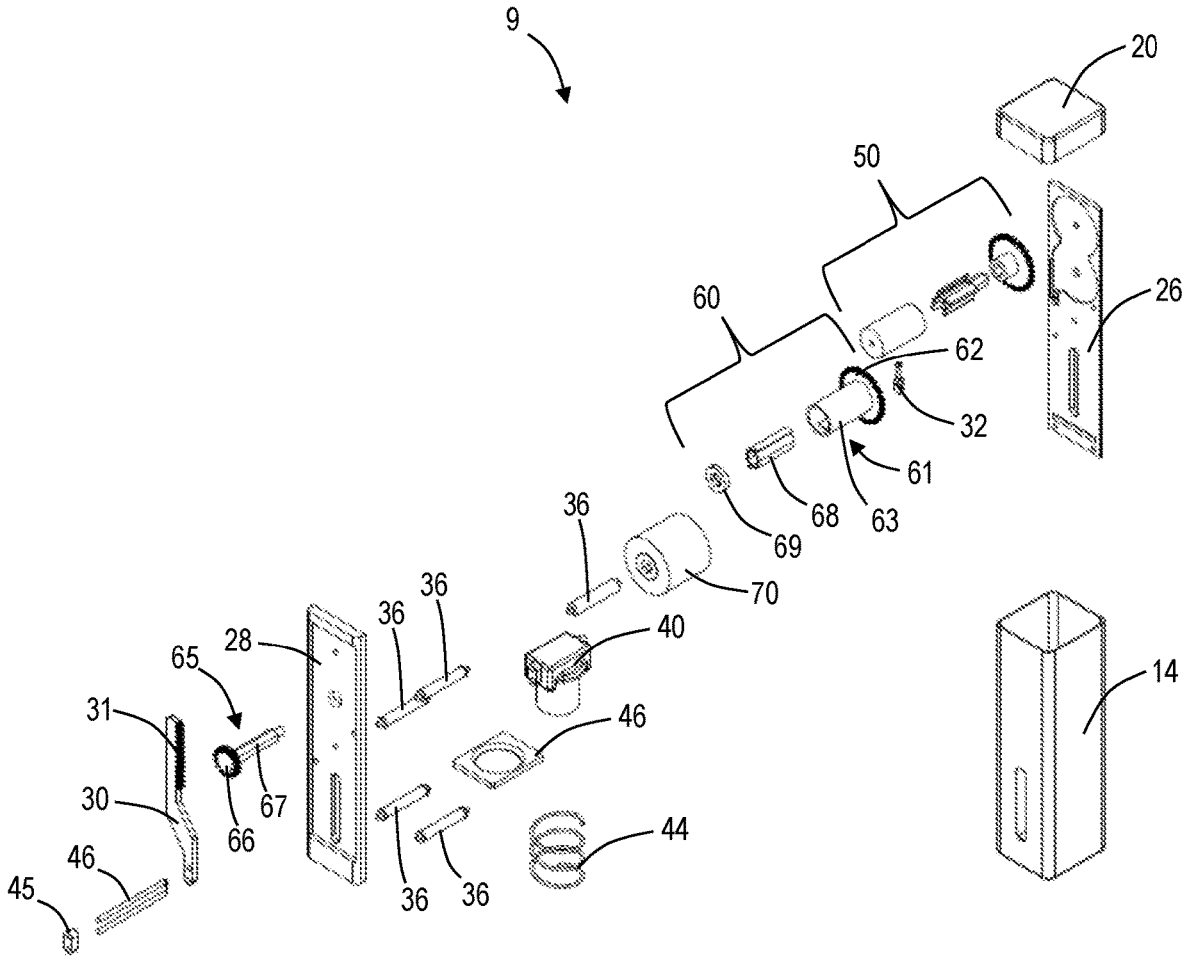
FIG. 37 is an exploded perspective view of the illustrative embodiment of the cartridge assembly of FIG. 33.
Figure 38:
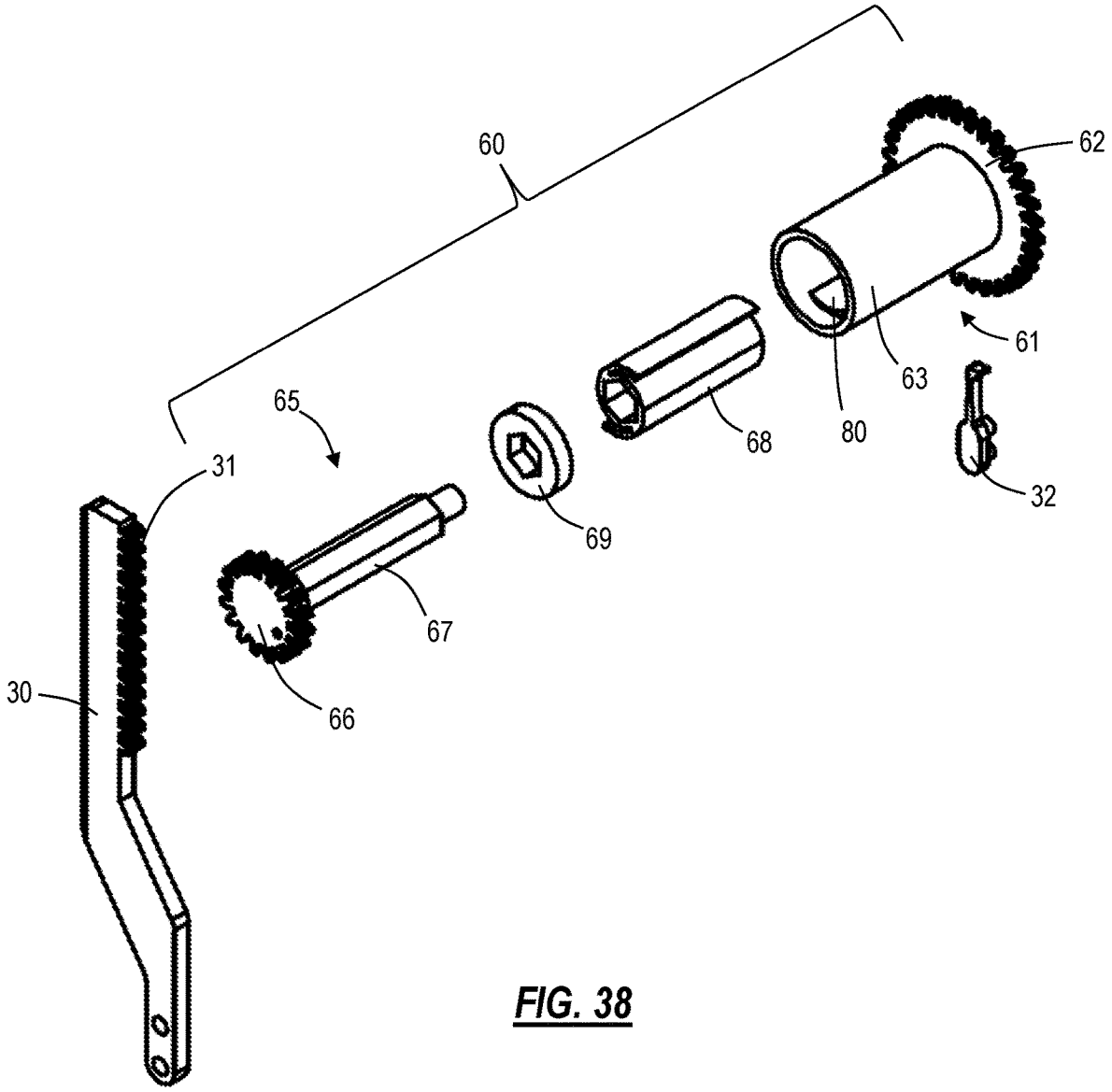
FIG. 38 is an exploded view of the tape rolling assembly of the adhesive dispenser of FIG. 33.

FIG. 33 is a perspective view of another illustrative embodiment of the adhesive dispenser 10 of the present disclosure. FIG. 34 is a bottom perspective view of the illustrative embodiment of the adhesive dispenser 10 of FIG. 33. FIG. 35 is a side perspective view of the illustrative embodiment of the adhesive dispenser 10 of FIG. 33. FIG. 36 is a cross-sectional view taken along the line XXXVI-XXXVI of the illustrative embodiment of the adhesive dispenser 10 of FIG. 33. FIG. 37 is an exploded perspective view of the illustrative embodiment of the cartridge 9 assembly of FIG. 33. FIG. 38 is an exploded view of the tape rolling assembly 60 of the adhesive dispenser 10 of FIG. 33. Referring to FIGS. 33-38, in embodiments, the tape rolling assembly 60 includes a ratchet element 68 adapted to be received in the cylindrical body 63 of the roller 61. The rachet element 68 includes multiple ratchet arms that are adapted to catch on protrusions 80 within the cylindrical body 63 while the roller axle 65 is rotating in the feed direction and is adapted to slide past the protrusions 80 while the roller axle 65 is rotating in the direction opposite the feed direction. In the embodiment illustrated, the ratchet element 68 includes two ratchet arms and the cylindrical body 63 includes two protrusions, each being rotated 180 degrees apart.

In embodiments, the roller axle body 67 includes a male screw drive, while the ratchet element 68 includes a female screw drive to mate therewith. In embodiments, the screw drives are one of a slotted drive, a cruciform drive, a square drive, an internal hex drive, and the like.

In embodiments, the tape rolling assembly 60 also includes a spacer 69 that is adapted to position the ratchet element 68 axially relative to the protrusions 80.

Referring to FIG. 36, in the embodiment illustrated, a fourth tape guide rollers 36 is positioned vertically between the dispensing pool assembly 70 and the tape rolling assembly 60 and aligns with another of the tape guide rollers 36 to guide the waste adhesive tape up from the bottom portion 15 of the cartridge 14 and is adapted to control an angle at which the waste adhesive tape is fed to the cylindrical body 63 of the rolling assembly 60.

Figure 39:
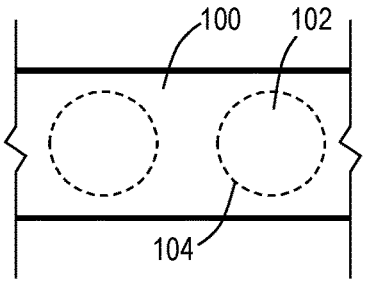
FIG. 39 is a top perspective view of an adhesive tape from a dispensing spool **74*a* of the adhesive dispenser of FIG. 33**.

FIG. 39 is a top perspective view of an adhesive tape 100 from a dispensing spool 74 of the adhesive dispenser 10 of FIG. 33. In embodiments, the adhesive tape 100 includes sections 102 therein with perforations 104 there around. The perforations 104 are adapted to facilitate the separations of the sections 102 from the remainder of the adhesive tape 100.

In particular, the sections 102 are sized and shaped to match that of a base of the applicator 42. While the section 102 is shown as being circular, other shapes for the section 102, such as polygons, regular polygons, rectangles, ovals, and the like, are also contemplated. In embodiments, upon actuation of the plunger assembly 40, the adhesive tape 100 is pressed against the internal surface 19 of the bottom portion 15 with the section 15 positioned over the opening 18 and then separated by the applicator 42 as the portions of the adhesive tape 100 between the perforations 104 are torn.

In some embodiments, the perforations 104 are preformed in the adhesive tape 100 prior to be spooled onto the dispensing spool 74. In these embodiments, the amount of adhesive tape 100 fed through the cartridge assembly 9 is the same as the distance between the center of adjacent sections 102. As such, after the dispensing of one section 102, the adhesive tape 100 is fed through the cartridge assembly 9 such that the next section 102 is positioned over the opening 18 to be dispensed. In some embodiments, the section 102 is positioned immediately before the dispensing of the section 102, while in other embodiments, the section 102 is positioned immediately after the dispensing of a previous section 102.

In other embodiments, the perforations 104 are formed in the adhesive tape 100 within the cartridge assembly 9. In embodiments, the perforations 104 are formed after the adhesive tape 100 is unspooled from the dispensing spool 74 and prior to the section 102 being separated from the remainder of the adhesive tape 100 by the applicator 42. In some of these embodiments, the plunger assembly 40 is adapted to operate in two stages. In a first stage, the plunger assembly 40 perforates the pattern of perforations around the section 102 into the adhesive tape 100, and in a second stage the plunger assembly 40 punches the pattern out of the adhesive tape 100 and applies the section 102 to the substrate. The waste adhesive tape is then wound as disclosed above and the adhesive tape 100 is pulled through for the next section 102 to be formed into and punched therefrom.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. An adhesive dispenser, comprising:

a cartridge defining a cavity;

a dispensing roll positioned within the cavity and adapted to dispense an adhesive tape;

a plunger assembly positioned within the cavity and adapted to move relative to the cartridge;

a handle adapted to receive the cartridge therein and adapted to move the plunger assembly relative to the cartridge such that the plunger assembly applies a section of the adhesive tape to a surface adjoining a bottom portion of the cartridge; and a tape rolling assembly positioned within the cartridge and adapted to feed the adhesive tape through the cartridge, the tape rolling assembly includes a roller adapted to only rotate in a feed direction of the adhesive tape.

2. The adhesive dispenser of claim 1, further comprising a biasing element that is adapted to bias the plunger assembly away from the bottom portion of the cartridge such that after the section of the adhesive tape is applied to the surface, the biasing element pushes the plunger assembly and the handle away from the bottom portion of the cartridge.

3. The adhesive dispenser of claim 1, further comprising an arm connected to the plunger assembly, the arm being adapted to rotate the tape rolling assembly to cause the tape rolling assembly to feed the adhesive tape through the cartridge.

4. The adhesive dispenser of claim 1, further comprising a waste spool assembly positioned within the cartridge downstream of the tape rolling assembly, the waste spool assembly is adapted to be rotated by the roller and is adapted to spool waste adhesive tape that has the section removed therefrom.

5. The adhesive dispenser of claim 4, wherein the waste spool assembly includes a ratcheting arrangement such that a waste spool of the waste spool assembly rotates less than the roller such that an amount of waste adhesive tape fed by the roller matches the amount of waste adhesive tape spooled by the waste spool.

6. The adhesive dispenser of claim 1, wherein the adhesive tape includes a plurality of sections, each of the plurality of sections being defined by perforations defining a shape thereof, and wherein the section is applied to the surface by tearing portions of the adhesive tape between the perforations to separate the section from the adhesive tape.

7. The adhesive dispenser of claim 1, wherein the bottom portion of the dispenser includes an opening surrounded by an internal surface, and wherein the internal surface comprises a feature chosen from at least one of a material and a texture that limits adhesion of the adhesive tape thereto.

8. An adhesive dispenser, comprising:

a cartridge defining a cavity and including slots in opposing sides thereof;

a dispensing roll positioned within the cavity and adapted to dispense an adhesive tape;

a plunger assembly positioned within the cavity and adapted to move relative to the cartridge, the plunger assembly including catches, wherein each of the catches extends through one of the slots; and a handle adapted to receive the cartridge therein, the handle including notches with the catches received therein whereby the handle moves the plunger assembly relative to the cartridge such that the plunger assembly applies a section of the adhesive tape to a surface adjoining a bottom portion of the cartridge.

9. The adhesive dispenser of claim 8, further comprising a spring extending between a top portion of the plunger assembly and a retaining plate that is positioned adjacent to and offset from the bottom portion of the cartridge, wherein the spring is adapted to bias the plunger assembly away from the bottom portion of the cartridge such that after the section of the adhesive tape is applied to the surface, the spring, being compressed, pushes the plunger assembly and the handle away from the bottom portion of the cartridge.

10. The adhesive dispenser of claim 8, further comprising a tape rolling assembly positioned within the cartridge, the tape rolling assembly comprising:

a roller including roller gear and a cylindrical body that is adapted to rotate in a feed direction to feed the adhesive tape through the cartridge; and a roller axle including a roller axle body received in the cylindrical body in a ratcheting relationship and a roller axle gear positioned at a side opposite the roller gear.

11. The adhesive dispenser of claim 10, further comprising:

an arm connected to the plunger assembly, the arm including teeth that mesh with the roller axle gear, such that actuation of the plunger assembly causes rotation of the roller axle; and a brake adjoining the roller gear and adapted to prevent rotation of the roller in a direction opposite the feed direction.

12. The adhesive dispenser of claim 11, further comprising a waste spool assembly positioned within the cartridge downstream of the tape rolling assembly, the waste spool assembly comprising:

a waste spool adapted to respool the adhesive tape after the section is removed therefrom;

a waste spool gear adapted to mesh with the roller gear; and a ratcheting feature adapted to transfer rotation from the waste spool gear to the waste spool until a predetermined force is reached, at which point, the waste spool gear slips relative to the waste spool gear, such that an amount of the adhesive tape taken up by the waste spool matches an amount of waste spool being fed by the roller.

13. The adhesive dispenser of claim 12, wherein the predetermined force is based on a minimum force required to tear the adhesive tape, after sections have been removed therefrom, being spooled by the waste spool.

14. The adhesive dispenser of claim 8, wherein the adhesive tape includes a plurality of sections, each of the plurality of sections being defined by perforations defining a shape thereof, and wherein the section is applied to the surface by tearing portions of the adhesive tape between the perforations to separate the section from the adhesive tape.

15. The adhesive dispenser of claim 8, wherein the bottom portion of the dispenser includes an opening surrounded by an internal surface, and wherein the internal surface comprises a feature chosen from at least one of a material and a texture that limits adhesion of the adhesive tape thereto.

16. An adhesive dispenser, comprising:

a cartridge defining a cavity;

a dispensing roll positioned within the cavity and adapted to dispense an adhesive tape;

a plunger assembly positioned within the cavity and adapted to move relative to the cartridge;

a handle adapted to receive the cartridge therein and adapted to move the plunger assembly relative to the cartridge such that the plunger assembly applies a section of the adhesive tape to a surface adjoining a bottom portion of the cartridge;

a biasing element that is adapted to bias the plunger assembly away from the bottom portion of the cartridge such that after the section of the adhesive tape is applied to the surface, the biasing element pushes the plunger assembly and the handle away from the bottom portion of the cartridge;

a tape rolling assembly positioned within the cartridge adapted to feed the adhesive tape through the cartridge, the tape rolling assembly including a roller adapted to only rotate in a feed direction of the adhesive tape;

an arm connected to the plunger assembly, the arm being adapted to rotate the tape rolling assembly to cause the roller to feed the adhesive tape through the cartridge; and a waste spool assembly positioned within the cartridge downstream of the tape rolling assembly, the waste spool assembly is adapted to be rotated by the roller and is adapted to spool waste adhesive tape that has the section removed therefrom, wherein the waste spool assembly includes a ratcheting arrangement such that a waste spool of the waste spool assembly rotates less than the roller such that an amount of waste adhesive tape fed by the roller matches the amount of waste adhesive tape spooled by the waste spool.

17. The adhesive dispenser of claim 16, wherein the adhesive tape includes a plurality of sections, each of the plurality of sections being defined by perforations defining a shape thereof, and wherein the section is applied to the surface by tearing portions of the adhesive tape between the perforations to separate the section from the adhesive tape.

18. The adhesive dispenser of claim 16, wherein the bottom portion of the dispenser includes an opening surrounded by an internal surface, and wherein the internal surface comprises a feature chosen from at least one of a material and a texture that limits adhesion of the adhesive tape thereto.

19. An adhesive dispenser, comprising:

a cartridge defining a cavity;

a dispensing roll positioned within the cavity and adapted to dispense an adhesive tape;

a plunger assembly positioned within the cavity and adapted to move relative to the cartridge;

a handle adapted to receive the cartridge therein and adapted to move the plunger assembly relative to the cartridge such that the plunger assembly applies a section of the adhesive tape to a surface adjoining a bottom portion of the cartridge;

a tape rolling assembly positioned within the cartridge and adapted to feed the adhesive tape through the cartridge; and an arm connected to the plunger assembly, the arm being adapted to rotate the tape rolling assembly to cause the tape rolling assembly to feed the adhesive tape through the cartridge.

* * * * *